US007559831B2

(12) United States Patent
Umeda

(10) Patent No.: US 7,559,831 B2
(45) Date of Patent: Jul. 14, 2009

(54) BELT-DRIVEN COIN SEPARATING APPARATUS

(75) Inventor: Masayoshi Umeda, Iwatsuki (JP)

(73) Assignee: Asahi Seiko Kabushiki Kaisha, Tokyo (JP)

( * ) Notice: Subject to any disclaimer, the term of this patent is extended or adjusted under 35 U.S.C. 154(b) by 601 days.

(21) Appl. No.: 10/830,229

(22) Filed: Apr. 22, 2004

(65) Prior Publication Data

US 2005/0042981 A1 Feb. 24, 2005

(30) Foreign Application Priority Data

Apr. 24, 2003 (JP) ..... 2003-119141

(51) Int. Cl.
*G07D 3/00* (2006.01)

(52) U.S. Cl. ..... 453/11; 453/56; 271/274; 198/608; 198/611; 198/626.4

(58) Field of Classification Search ..... 453/11, 453/56; 271/274; 198/608, 611, 626.4
See application file for complete search history.

(56) References Cited

U.S. PATENT DOCUMENTS 1,863,510 A * 6/1932 Taylor ..... 198/604
3,680,853 A * 8/1972 Houghton et al. ..... 271/3.2
4,155,440 A * 5/1979 Bogdanski et al. ..... 198/399
4,620,807 A * 11/1986 Polit ..... 400/56
4,920,730 A * 5/1990 Inoue et al. ..... 53/532
5,015,214 A * 5/1991 Suzuki ..... 453/56
5,022,890 A * 6/1991 Rapp ..... 453/56
5,135,433 A * 8/1992 Watanabe et al. ..... 453/3
5,355,988 A * 10/1994 Shirasawa ..... 194/217
5,382,191 A * 1/1995 Rasmussen ..... 453/11
5,595,284 A * 1/1997 Takahashi et al. ..... 198/847
5,722,882 A * 3/1998 Kashiwagi et al. ..... 453/11
6,003,652 A * 12/1999 Murata et al. ..... 194/206
6,059,650 A * 5/2000 Stoltz et al. ..... 453/40
6,086,472 A * 7/2000 Furukawa ..... 453/3
6,368,204 B1 * 4/2002 Tokoyoda ..... 453/57
6,467,767 B2 * 10/2002 Yano ..... 271/122
2004/0134757 A1 * 7/2004 DeVries et al. ..... 198/497
2005/0042981 A1 * 2/2005 Umeda ..... 453/11

FOREIGN PATENT DOCUMENTS

JP 2002-99939 5/2002

* cited by examiner

*Primary Examiner*—Patrick H Mackey
*Assistant Examiner*—Kalyanavenkateshware Kumar

(57) ABSTRACT

A coin separating unit of a compact configuration for separating coins of different thicknesses from a bulk supply includes a coin transporting unit such as a rotating belt having a support surface of a predetermined flexibility and friction characteristic. A separating roller unit is positioned above a support surface and rotates in a direction opposite to the movement of the belt. A supporter unit is operatively located upstream of the separating roller unit and can displace coins that are overlaid with each other. The belt has sufficient flexibility so that a gap between the surface of the belt and a separating roller unit can be increased to accommodate a particular thickness of coin as it passes beneath the separating roller unit.

24 Claims, 10 Drawing Sheets

BELT-DRIVEN COIN SEPARATING APPARATUS

BACKGROUND OF THE INVENTION

1. Field of the Invention

The present invention is directed to the separation of coins fed in bulk and more particularly to a relatively efficient and inexpensive separation of relatively small amounts of coins of different sizes presented in a bulk condition for transportation by a belt.

2. Description of Related Art

There are various examples in the industry of distributing coins, medallions, tokens, and various forms of monetary coins of separating such items. For example, Japanese Laid-open Patent Application 2002-99939 teaches a transporting belt that can transport bulk coins on the belt to a roller positioned at a distance which is slightly greater than the thickness of the bigger coins to be separated and slightly thinner than two relatively thin coins that can be overlaid. The roller can rotate in an opposite direction or a counter direction to the transporting direction of the belt. If coins become stuck between the transporting belt and the roller, the transporting belt will be stopped and rotated in an opposite direction and at the same time that the roller will also rotate in the same direction to provide an effect of dislocating the jammed coins.

The prior art has experienced problems with smaller sized coins that could pass through such a space, and attempts have been made to narrow the gap between the belt and the roller. However, this solution sometimes has difficulty if thicker coins are utilized. Thus, there is still a need in the prior art to improve the separation of coins that are being transported on a belt.

SUMMARY OF THE INVENTION

The present invention provides a relatively inexpensive and compact coin separating unit which can separate coins stored in bulk which are released onto a lower transporting belt while preventing jamming effects despite the varying thicknesses of the coins. The coin separating unit can separate the bulk coins one by one despite various thickness differences between different types of coins.

The present invention provides a coin separating unit of a relatively inexpensive configuration which includes a coin transporting unit that can operatively interact with a hopper or bulk coin dispenser. The coin transporting unit receives the coins and transports them for subsequent processing. A separating roller unit can be provided above the coin transporting unit and set, for example, to provide a gap space of approximately two times the thinnest of the coins that it will process. The roller's surface can move in an opposite or counter-direction to the coin supporting surface of the transporting belt. The belt and the separating roller, however, are also designed to move relative to each other for increasing the gap space under certain circumstances. A supporting unit such as a roller can be located upstream from the separating roller and is also spaced above the coin supporting surface of the belt at a distance which is approximately the thickness of the thinnest coins to be processed. The supporting roller can move relative to the coin transporting unit when contacted by a coin on the belt.

In this structure, bulk coins are transported by the transporting unit and arrive at the supporter unit. When the coins are not piled up, a coin lifts up the supporter unit so that it arrives at the separating roller unit to be sandwiched between the coin transporting unit and the supporter unit. The separating roller is located above the coin transporting unit at a distance which is, at most, two times the thickness of the thinnest coin or less. Therefore, the thinnest coin does not have contact with the separating roller or only slight contact with the separating roller. As a result, the thinnest coin does not receive or slightly receives a moving resistance.

When the distance is thinner than the thinnest coin, the coins on the coin transporting unit have contact with the separating roller which rotates in an opposite direction from the moving direction of the coin transporting unit. Therefore, the coins receive a resistance opposite to the transporting direction. However, the coin is still transported towards the transporting direction by the transporting unit, because the contacting area between the coin transporting unit and the coin is larger than the contacting area between the coin and the separating roller. When the coin is located between the coin transporting unit and the separating roller, the distance between the coin transporting unit and separating roller becomes the thickness of the coin. As a result, the coin passes between the coin transporting unit and the separating roller.

If two coins are piled up, the upper coin is stopped by the supporter unit. The lower coin moves together with the coin transporting unit, because the lower coin has contact with the relatively high-friction coin transporting unit. Therefore, the lower coin lifts the supporter unit and goes forward to the separating roller. The separating roller is located at a distance, which is, at most, two times the thickness of the thinnest coin or less from the coin transporting unit. The lower coin does not have contact with the separating roller or it receives a small resistance. Accordingly, the lower coin is transported in the transporting direction by the friction. However, when the upper coin lifts the supporter and arrives at the separating roller, it is stopped by the separating roller and it is displaced from the lower coin.

When a coin, which has contact with the coin transporting unit, passes between the supporter and the separating roller, the upper piled-up coin moves backward onto the transporting unit. In this case, when the thickest coin is used, the thickness of the coin is thicker than the distance between the transporting unit and the separating roller, such a coin will lift up the supporter unit. In other words, the coins are pushed into coin transporting unit by the weight of the supporter unit. In this situation, when the end of a coin goes to the separating roller, the surface of the separating roller which rotates in a counter direction stops the coin.

However, the coin is pushed into the coin transporting unit by the supporter unit. Therefore, the friction between the coin and the transporting unit is larger. Accordingly, the coin transporting unit is bent downward by the coin, and the coin is drawn between the coin transporting unit and the separating unit. A coin which is stuck between the transporting unit and the separating unit receives a force which is returned in a counter direction by the separating roller. However, the contacting area which is between the transporting unit and the coin is larger than the contacting area which is between the coin and the separating roller. Therefore, the coin moves together with the transporting unit, and it passes between the separating roller and the coin transporting unit. Accordingly, even when the coin thickness is large, the piled-up coins are separated one by one.

The present invention is desirable, because the coin transporting unit can resiliently bend the coin supporting surface in a traverse direction to the coin moving direction, and the position of the separating roller is fixed at a predetermined position. In this structure, the separating roller rotates. Therefore, the driving mechanism can be made both relatively uncomplicated and inexpensively. Also, the transporting unit can bend based on a predetermined self-elasticity to alter the distance through which a coin can pass. This function occurs based on a tension control feature of the transporting unit. Therefore, the unit is inexpensive and rarely breaks down, because the structure is simple.

This present invention is further desirable, because the supporter unit is a roller. In this structure, the supporter unit pushes the coin into the coin transporting unit and is rotated by the movement of the coin. Therefore, when the supporter unit runs up onto the coin, the supporter unit does not substantially provide a large resistance to the coin, because the supporter rotates. Also, the breaking up of the piled-up coins is smooth.

This present invention is desirable, because a coin drawing auxiliary unit is located downstream of the separating roller unit. In this structure, a coin which passed between the separating roller and the transporting unit is drawn by the coin drawing auxiliary unit. Therefore, the coin passes between the separating roller and the transporting unit faster, because the coin is drawn by a rather larger force. As a result, piled-up coins are broken down faster, because the coin speed is not reduced between the separating roller and the coin transporting unit.

The separating roller rotates in the same direction as the coin transporting unit, but its relative position provides an opposed movement to the coin support surface of the coin transporting unit. In this structure, when the coin transporting unit is relatively moved in a counter direction for cancelling a coin jamming, the separating roller rotates in the normal direction. In other words, the coin transporting unit moves in a returning direction to the coin; also the separating roller rotates in the returning direction to the coin. Therefore, the jammed coins are transported in the returning direction by the transporting unit. As a result, the jammed coins are canceled quickly.

This present invention is desirable, because the supporting roller is rotatable on a lever which is pivotable and is coaxially to the separating roller; also it is urged towards the coin transporting unit by a predetermined force.

This present invention is further desirable, because the supporting roller has contact with the transporting unit and is rotated by the coin transporting unit. In this structure, when there are no coins, the supporting roller rotates when it has contact with the coin transporting unit. When the piled-up coins arrive, the supporter unit contacts the piled-up coins by self-rotation. Therefore, the coins are pushed to the coin transporting unit by the supporter unit. In other words, the coins go between the supporting roller and the coin transporting unit easier. Therefore, the separation of coins is achieved faster, because the coins move together with the coin transporting unit.

This present invention is desirable, because a second coin transporting unit is located downstream of the coin transporting unit and moves faster than the coin transporting unit. In this structure, a coin has contact with the second transporting unit in a situation where the coin is held between the coin transporting unit and the separating roller. Also, the coin is drawn faster by the speed of the second transporting unit. Therefore, the coin is drawn positively from the coin transporting unit and the separating roller. As a result, the separation of the coins is achieved faster.

This present invention is desirable, because a drawing auxiliary unit is a roller which is located downstream from the separating roller and has a distance which is thinner than the thinnest coin and is located away from the second coin transporting unit. In this structure, the coin is held between the drawing auxiliary unit and the transporting unit in the situation where the coin is held between the coin transporting unit and the separating roller. The drawing auxiliary unit is a roller. Therefore, the coin is pushed into the coin transporting unit by the roller; also it does not approximately slip relative to the coin transporting unit. As a result, the separation for the coins is achieved faster, because the coin is drawn positively from the coin transporting unit and the separating unit.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

Figure 1:
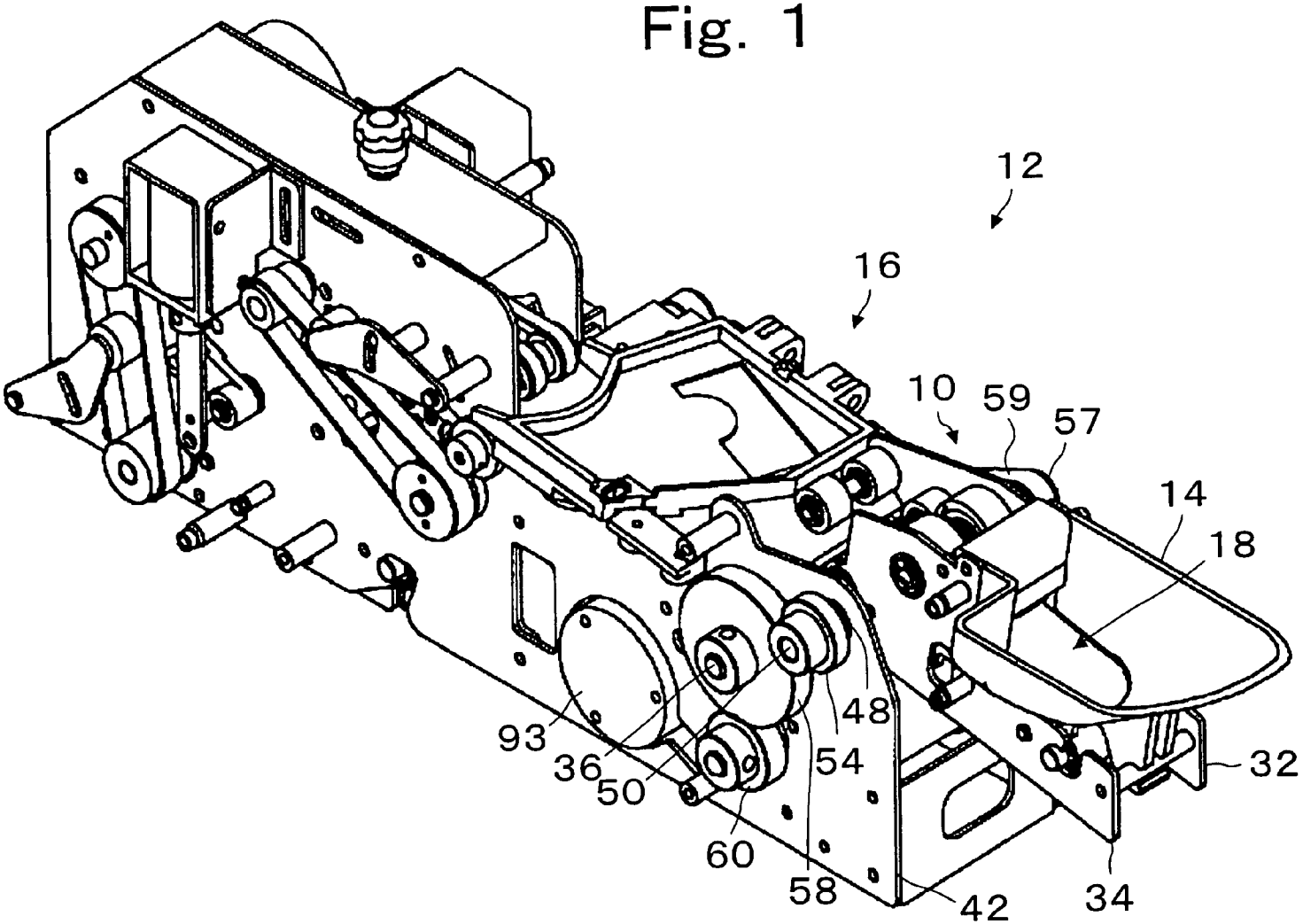
FIG. 1 is a perspective view from over front and left side where the coin separating unit of the embodiment is attached.

Reference will now be made in detail to the preferred embodiments of the invention which set forth the best modes contemplated to carry out the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

Coin separating unit 10 can be used in a coin receiving unit 12, for example, an automatic receiving and dispensing machine for coins. Also, it can be used to receive coins in a receiving opening or hopper 14 in a bulk coin situation and the coins can be separated one by one, and afterwards the coins are transported to a denomination distinguishing section 16.

The distinguished coins are transported for subsequent processing; for example, the coins can be transported to a dispensing section and can be stored in separate denominations; also the coins can be dispensed based on a dispensing signal.

Coin separating unit 10 further includes a coin transporting unit 18, a separating roller unit 20, a supporter unit 22 and drawing auxiliary unit 24. However, drawing auxiliary unit 24 is only used as occasion demands.

First, coin transporting unit 18 is explained. Coin transporting unit 18 includes a pair of pulleys 26, 28, and a belt 30 which is operatively located around the pulleys. Belt 30 has a function that when a coin C is held between the separating roller unit 20 and transporting unit 18, the transporting unit 18 is bent by a predetermined elasticity. Belt 30 is a plane belt which can be made of a urethane rubber with a reinforcing core which can be made of polyamide. The material of belt 30 is made up of a rubber hardness that can equal 76 HS, the Young ratio can be equal to 1000 gf/cm width (in 10% extends), and it is used to normally extend 8% as a desirable range. The belt provides a relatively high friction surface compared to a metal coin.

For example, a Hopina belt F which is made by the Hokushin Industry Co., Ltd. can be used. However, when belt 30 does not have sufficient stretchability, either pulley 26 or 28 can be mounted to more freely and with some resilient effect. Also, when a belt 30 which does not have stretchability is used, the belt 30 can be further supported by a tension roller which is supported to move freely and resiliently. Plural round belts or plural narrow belts can be located in parallel, and they can make up substantially the plane belt. Therefore, coin transporting unit 18 can change the distance between the after-mentioned separating roller 20 by a relative movement of the belt.

Figure 3:
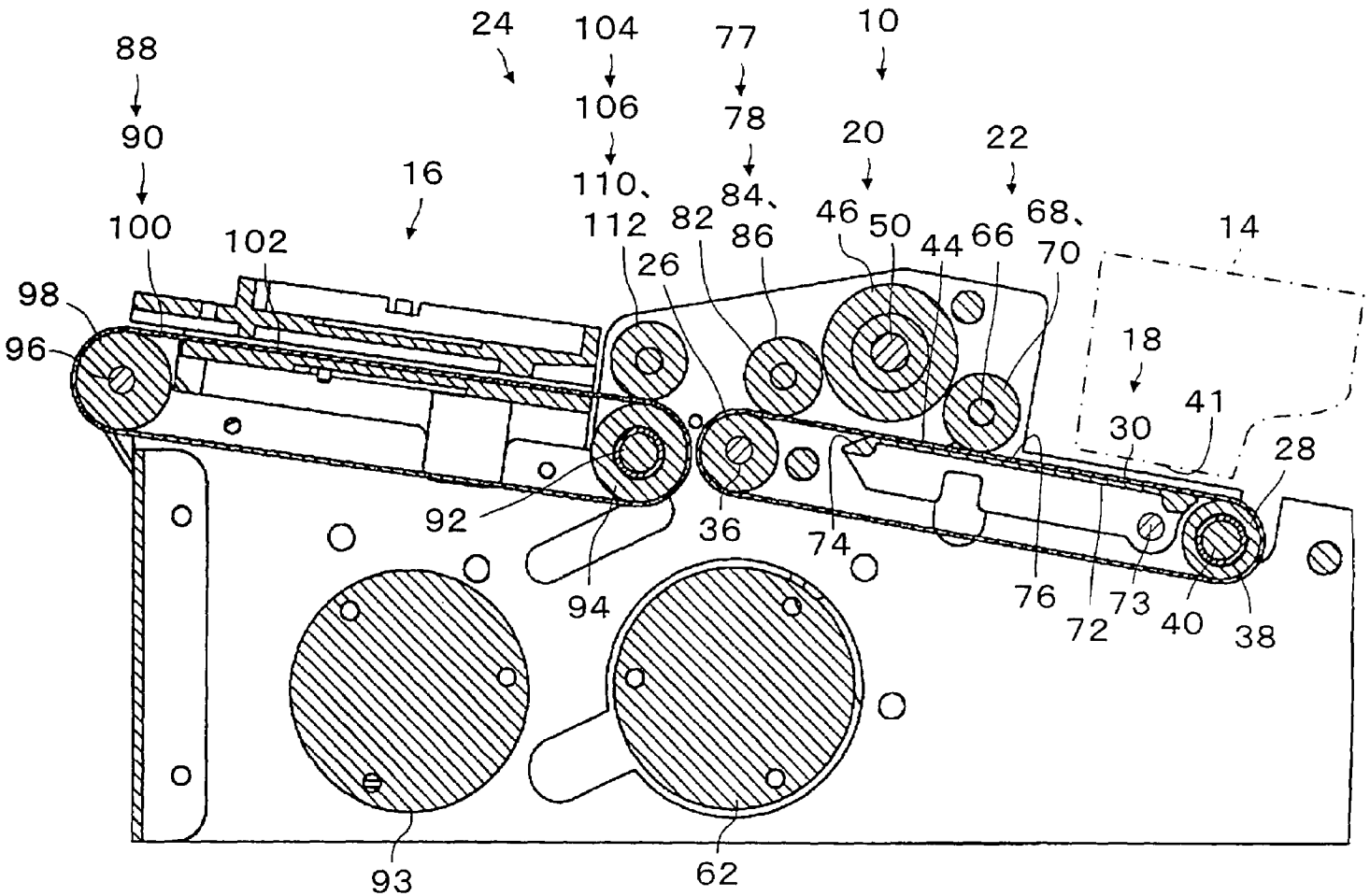
FIG. 3 is a cross-section view of the X-X line in FIG. 2.

Belt 30 is slightly wider than the diameter of the largest coin to be used and is narrower than the double diameter of the smallest coin to be transported. Accordingly, the parallel or overlaid coins cannot pass through or between separating roller 20 and belt 30. As shown in FIG. 3, pulley 26 is fixed at shaft 36 which is located parallel to frames 32, 34 and is rotatable. As shown in FIG. 1, pulley 28 is fixed at shaft 40 which is attached to frames 32, 34 through a bearing 38, and is accordingly rotatable.

Pulley 26 is located above pulley 28, so that belt 30 will receive coins from the bottom of the hopper 14 in the transporting direction (the storing direction). In such a structure, any piled-up coins in the hopper 14 can fall down naturally by gravity feed. Therefore, this structure is desirable; however, belt 30 can be located in a level or horizontal position. Lower opening 41 of hopper 14 is located over pulley 28 for the belt 30, and received coins are released on the belt 30 at this position.

Next the separating roller 20 is explained. Separating roller 20 has a function of dispensing coins where the coins which are transported by coin transporting unit 18 become piled up. Separating roller 20 is located between frames 32 and 34 and is located at a predetermined distance from the coin transporting surface 44 of belt 30 near pulley 26. When coins of different thicknesses are processed, the predetermined distance is thinner than double the thickness of the thinnest coin, a distance which is set by only the thinnest coin, and the double thinnest coin size is desirable. Therefore, when the thickness of the thickest coin is thicker than double the thinnest coin, the distance is thinner than the thickness of the thickest coin. In other words, when the thickest coin passes between belt 30 and separating roller 20, belt 30 is bent elastically, because the position of separating roller 20 is fixed. However, when the thinnest coin passes through, belt 30 can slightly bend.

Figure 2:
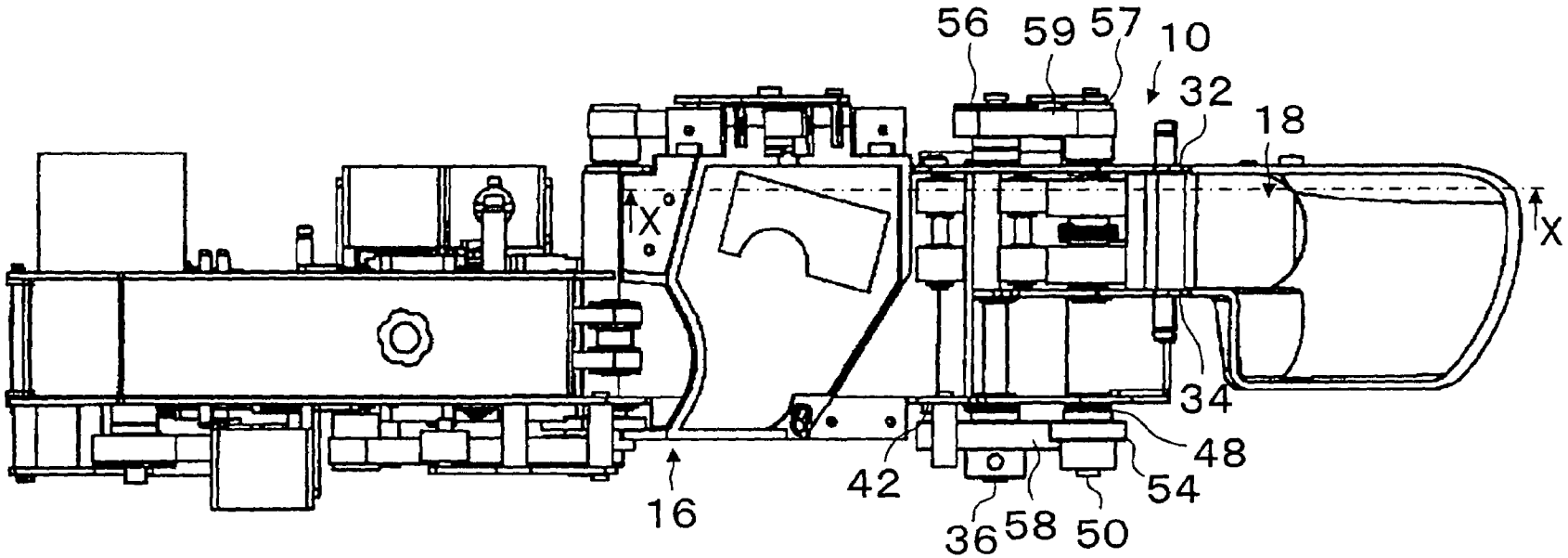
FIG. 2 is a plane view of the coin receiving unit which is attached to the coin separating unit of the embodiment.

Separating roller 20 is a ring roller 46 which is made of urethane rubber and is fixed at rotating shaft 50. Rotating shaft 50 is supported on frames 32 and 42 and is rotatable. Therefore, separating roller 20 rotates at a fixed position to coin transporting unit 18. Gear 54 is fixed at the protruding end of rotating shaft 50 from frame 42 through a one-way clutch 48 as shown in FIG. 2.

When gear 54 rotates in a counterclockwise direction as shown in FIG. 1, one-way clutch 48 rotates. When gear 54 rotates in a clockwise direction, one-way clutch 48 does not transmit the rotating force to the separating roller 20. Gear 54 is engaged with gear 58 which in turn is fixed at rotating shaft 36 which is rotatably supported by frames 42 and 32. Gear 58 engages with gear 60. Gear 60 is rotated by motor a 62 which is located below coin separating unit 10 through a reducer assembly.

Pulley 26 is fixed at shaft 36. Pulley 56 is fixed at the protruding end of rotating shaft 36 outward from frame 32. Pulley 57 is attached at the end of rotating shaft 50 which protrudes outwards from frame 32 through a one-way clutch (not shown). Belt 59 is located around pulleys 56 and 57. When pulley 57 rotates in the counterclockwise direction as shown in FIG. 1, the one-way clutch rotates when pulley 57 rotates in the counterclockwise direction; rotating shaft 50 is not driven by pulley 57. In other words, when pulley 57 rotates in the counterclockwise direction, rotating shaft 50 rotates in the same direction; when it rotates in the clockwise direction, rotating shaft 50 is not driven by pulley 57.

Therefore, when pulley 26 rotates in the counterclockwise direction shown in FIG. 3, separating roller 20 rotates in the counterclockwise direction. Thus, coin supporting surface 44 of belt 30 moves in the left direction as shown in FIG. 3; separating roller 20 rotates in the counterclockwise direction through pulley 26, belt 59, pulley 57 and the one-way clutch (not shown). Therefore, the facing surface to coin supporting surface 44 to separating roller 20 moves in the right direction which is the counter direction. Also, when belt 30 moves in the right direction, separating roller 20 rotates in the counterclockwise direction shown in FIG. 3 through gears 54, 58 and one-way clutch 48. However, a one-way clutch does not rotate in separating roller unit 20.

Figure 4:
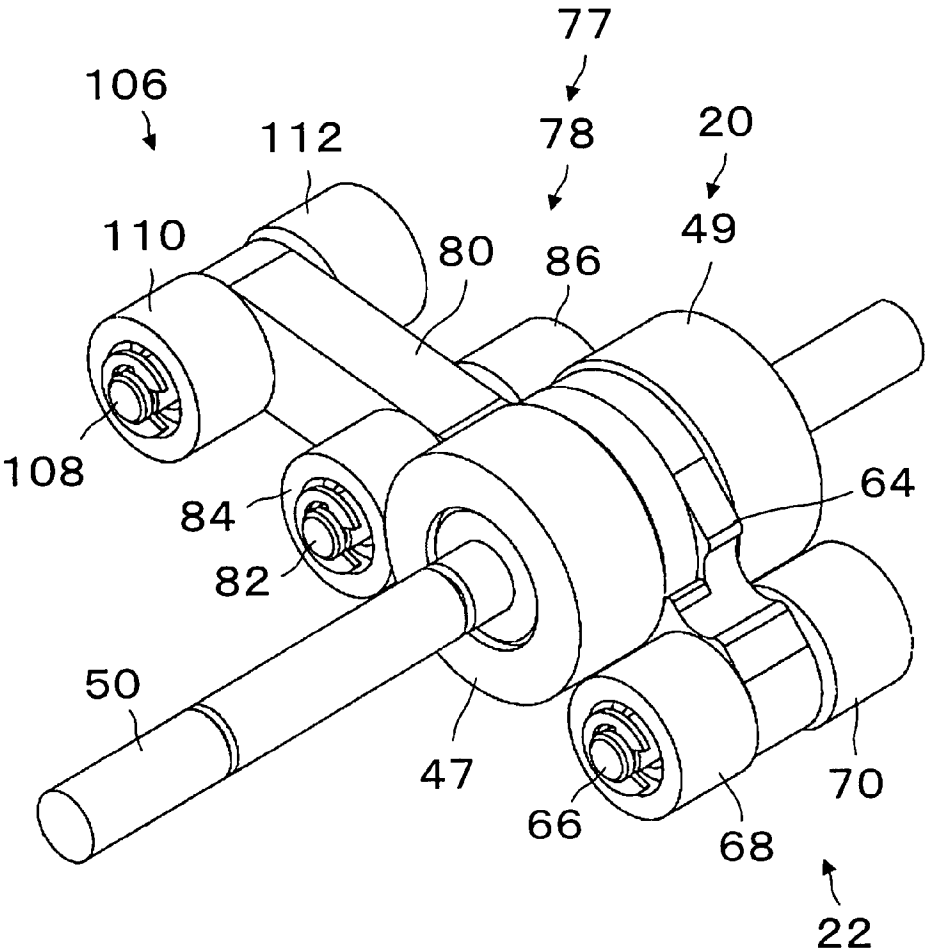
FIG. 4 is a perspective view of the separating unit of the embodiment.

Separating roller unit 20 is a pair of rollers 47, 49 which are of the same diameter and are located away from each other by a small distance as shown in FIG. 4. However, both the supporting structure of supporter unit 22 and a drawing auxiliary unit 24 could be modified for use as a unified roller with a predetermined width. Also, a large diameter for separating roller 20 is desirable; however, when the maximum diameter of the coins is approximately 30 mm, a diameter which is approximately 20 mm is also desirable.

Next, supporter unit 22 is explained. Supporter unit 22 has a function when coins are piled up and the upper coins are stopped. Also, supporter unit 22 has another function where a coin C is held between separating roller 20 and is pushed into belt 30. Therefore, supporter unit 22 is a roller in an after-mentioned embodiment; however, it can also provide additional weight.

As shown in FIG. 4, supporting lever 64 is attached at rotating shaft 50 between rollers 47 and 49 and is rotatable. It extends in the upstream side of the transporting direction of coin transporting unit 18. A pair of rollers 68 and 70 are rotatable on shaft 66 which is fixed at the end of lever 64 and is parallel to rotating shaft 50, and they are located at both sides of lever 64. In other words, supporting rollers 68 and 70 are located relating to rollers 47 and 49. However, either of the rollers 68 and 70 can be attached to each other. Rollers 68 and 70 are made from urethane rubber; however, they can be made from other materials, for example, a metal.

Lever 64 can provide a moment force which rotates in the clockwise direction based on the weight of shaft 66 and rollers 68 and 70. When the moment force is insufficient, a spring force can be further provided. Therefore, supporting rollers 68 and 70 are located at the upper portion of coin transporting unit 18 which is located near separating roller 20. In a normal situation, supporting rollers 68 and 70 have contact with the coin surface 44 of belt 30 and are rotated. However, supporting rollers 68 and 70 can be located at a small distance above surface 44. The small distance should be thinner than the thinnest coin.

The diameters of supporting rollers 68 and 70 are smaller than the diameter of separating roller 20. Optimally, the diameter is approximately half the size of separating roller 20 as shown in FIG. 3. In the specifics, the radius of rollers 68 and 70 is larger than the thickness of the thickest coin so that coin C which has contact with belt 30 can lift the supporter unit 22. In other words, the end of coin C has contact with the downward arc surface of supporting rollers 68 and 70; also it lifts the supporter unit 22 by a wedge effect. When supporting rollers 68 and 70 are located away from belt 30 and are lifted by the coin, the diameter of supporting rollers 68 and 70 can be made smaller than the maximum thickness.

Also, the center of rollers 68 and 70 can be located away from coin surface 44 of belt 30 at a distance which is the double thickness of the thickest coin. Because, supporter unit 22 is lifted up by the thickest coin, piled-up coins will not lift supporter unit 22, and the overlaid coins will be pushed back. When supporter unit 22 is not rotated, a slanting surface (which includes an arc surface) is formed at the upper section of transporting belt 30 to supporter unit 22.

Next, belt supporter 72 is explained. Belt supporter 72 has a function when the belt 30 is not bent at a predetermined volume. Belt supporter 72 is a rectangular plate and is located between the upper belt and the lower belt of coin transporting unit 18, and is rotatable on the end of shaft 73 which is fixed at frames 32 and 34 to provide a pivoting support member, and the other end 74 is located below separating roller 20. Also, supporting coin putting surface 76 has contact resiliently with the reverse of upper belt 30 in a tensioned situation of belt 30, and it supports upper belt 30.

In other words, when belt 30 is pushed downwards over a predetermined amount, belt supporter 72 moves downwards to a predetermined distance. The end of belt supporter 72, below separating roller 20, slants relative to belt 30 and surface 44 for the coins. Accordingly, when belt 30 moves in the counter direction to the transporting direction, belt 30 is not stopped by belt supporter 72. Belt supporter 72 has a function for controlling the amount of the bend of belt 30; however, it can be removed when belt 30 is sufficiently strong.

Next drawing auxiliary unit 24 is explained. Drawing auxiliary unit 24 has a function of moving a coin which is held between separating roller 20 and coin transporting unit 18 in the coin transporting direction quickly. In this embodiment, drawing auxiliary unit 24 is disclosed in three different types. First, first auxiliary drawing unit 77 is explained. Auxiliary drawing unit 77 is roller 78 which is located at a downstream side near the separating roller 20 and is located above coin transporting unit 18.

As shown in FIG. 4, roller 78 includes a pair of rollers 84 and 86 which are attached on shaft 82 which is located parallel to rotating shaft 50 and is fixed at lever 80 which is rotatable on rotating shaft 50 and located at the left and the right of the lever 80. Rollers 84 and 86 face separating roller 20 and have contact with coin putting surface 44 of belt 30 by the moment force adding to lever 80. Rollers 84 and 86 are made from the same material as supporting rollers 68 and 70 and have the same diameter.

Next a second drawing auxiliary unit 88 is explained. Second drawing auxiliary unit 88 is a second coin transporting unit 90 which is located downstream of coin transporting unit 18. As shown in FIG. 3, second transporting unit 90 is second belt 100 which is a plane belt and is positioned between pulley 94 which is fixed at shaft 92 and pulley 98 which is fixed at rotating shaft 96. However, second coin transporting unit 90 could be changed to a plurality of circle belts which are located in parallel.

Belt 100 slants, where a second coin putting surface 102 is located, on the same extending line of coin supporting surface 44. When coin supporting surface 44 of belt 30 moves in the left direction shown in FIG. 3, second coin putting surface 102 moves in the same direction, also the moving velocity is approximately 20% faster than the velocity of belt 30. Therefore, when the coin which is put on belt 30 has contact with second belt 100, the coin is drawn forward by second coin transporting unit 90. Shaft 92 is driven by motor 93 through a reducer unit (not shown). When motor 62 transports the coins to the side of second coin transporting unit 90, motor 93 relatively rotates; however, when motor 62 rotates in the clockwise direction, unit 90 is not rotated.

Next the third drawing auxiliary unit 104 is explained. Third drawing auxiliary unit 104 is roller 106 which is rotatable and located above second transporting unit 90. Roller 106 is rotatable on a shaft 108 which is fixed at lever 80 parallel to shaft 82 and includes a pair of rollers 110 and 112 which are located on the left and the right of lever 80.

Rollers 110 and 112 are made from the same material and size as rollers 68 and 70. When supporter unit 22, first drawing auxiliary unit 77 and third drawing auxiliary unit 104 use the same rollers, they are less inexpensive. Also, a coin distinguishing section 16 to separate different denominations is located at the upper part of second transporting unit 90.

Next the operation of this embodiment is explained. The coins entering into receiving slot 14 are detected by a sensor (not shown), motor 62 rotates and gear 60 rotates in the clockwise direction shown in FIG. 1; also gear 58 and rotating shaft 36 rotate in the counterclockwise direction. Pulley 26 rotates in the counterclockwise direction shown in FIG. 3; coin surface 44 of belt 30 moves in the left direction (towards the side of second transporting unit 90). On the one hand, gear 54 rotates in the clockwise direction by gear 58, and rotating shaft 50 is not rotated by one-way clutch 48.

The rotation of rotating shaft 36 is transmitted to a pulley (not shown) and belt 59 and pulley 57. Also, rotating shaft 50 is rotated in the counterclockwise direction shown in FIG. 3 through an unshown one-way clutch. Therefore, the surface which faces the coin supporting surface 44 of separating roller 20 moves to the right. Supporter unit 22 which is structured by rollers 68 and 70 and first drawing auxiliary unit 77 which is structured by rollers 84 and 86 rotate in the clockwise direction by friction-contact to belt 30 shown in FIG. 3.

Figure 5:
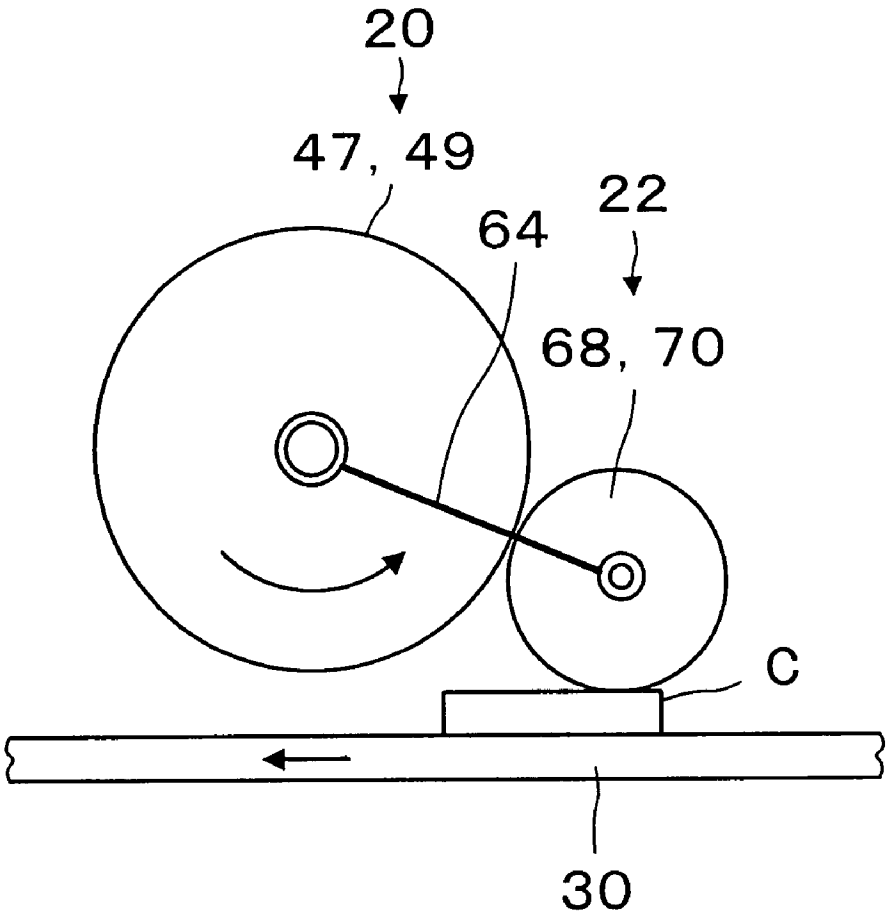
FIG. 5 is an explaining view for the operation of the embodiment where one thinnest coin is used.

Motor 93 rotates relative to the rotation of motor 62. Shaft 92 rotates in the counterclockwise direction shown in FIG. 3. Second coin putting surface 102 of second belt 100 moves in the left direction faster through pulley 94. Accordingly, rollers 110 and 112 of third drawing auxiliary unit 104 rotate in the clockwise direction shown in FIG. 3 by the contact to second belt 100. When the coins C are not piled up, the coins move together with belt 30, and it lifts supporter unit 22 as shown in FIG. 5. Accordingly, coin C is pushed downward into belt 30 by the moment force of supporter unit 22 and travels to separating roller 20.

When the thinnest coins C are received, coins C do not have contact with separating roller 20 or at least receive only a small resistance from separating roller 20. Therefore, the thinnest coins C move together with belt 30. When coins C are located between separating roller 20 and belt 30, they are not pushed into belt 30 by supporter unit 22; however, the coins C move together with belt 30, because the coins C have not received any counter-resistance.

The end of coin C which passed under separating roller 20 lifts rollers 84 and 86. In this situation, the rear end of coin C is located between belt 30 and separating roller 20. Therefore, coin C is pushed into belt 30 again, and also moves together with the belt 30. Next, coin C is pushed to second belt 100 which is the second drawing auxiliary unit 88 by rollers 110 and 112 which are third auxiliary drawing unit 104, and also move together with second belt 100, and pass through the denomination distinguishing section 16 to be transported to the next processing unit.

Figure 6:
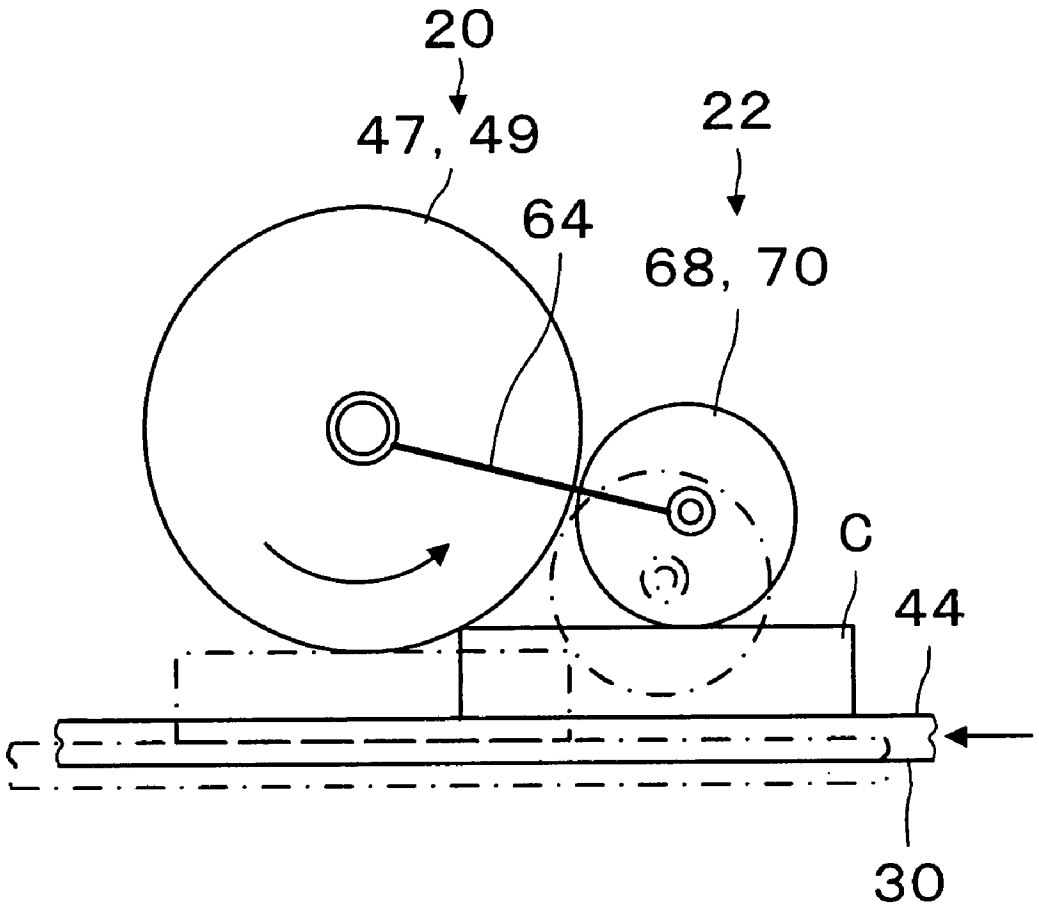
FIG. 6 is an explaining view for the operation of the embodiment where thickest coin is used.

When the thickest coins C are received, these coins C are pushed into belt 30 by supporter unit 22 as shown in FIG. 6; afterwards they go to separating roller 20. In this situation, the distance between coin supporting surface 44 of belt 30 and the lower surface of separating roller 20 is smaller than the thickness of the thickest coin. However, the friction force between coin C and belt 30 is large, because coin C is pushed into belt 30 by supporter unit 22. Also, the coins C receive a moving resistance in a counter direction to the transporting direction of belt 30 by the rotation of separating roller 20; however, the contacting area between separating roller 20 and coin C is small.

Therefore, coin C moves or slips in the same direction together with the belt 30, and is drawn into the space between separating roller 20 and belt 30, because belt 30 can bend resiliently. In other words, coin supporting surface 44 and separating roller 20 are separated by a thickness of the coin C, because belt 30 can bend resiliently. In this situation, belt supporter 72 beneath belt 30 can also move together with belt 30, and pivots in the counterclockwise direction at shaft 73, as shown in FIG. 3. When coin C is held by belt 30 and separating roller 20, the coin C receives the moving resistance by the counterclockwise rotation of separating roller 20; however, the coin C is transported to the side of second coin transporting unit 90 by belt 30, because the contacting area between belt 30 and coin C is larger.

When the end of coin C is pushed into belt 30 by rollers 84 and 86 which are the first auxiliary drawing unit 77, the coin C is pushed into belt 30 by a larger force. Therefore, the friction force between coin C and belt 30 increases, and coin C can pass through smoothly between belt 30 and the separating roller 20. Afterwards, coin C is held between rollers 110, 112 which are the third drawing auxiliary unit 104 and second belt 100 which is second drawing auxiliary unit 88, and it is drawn faster than belt 30; also it is transported by second transporting unit 90 as above-mentioned. When the coin has a large diameter, the coin is pushed to belt 30 by rollers 84 and 86, and it is pushed into second belt 100 by rollers 110 and 112 at the same time.

When a thicker coin is held by the coin transporting unit 18, and separating roller 20 is in the bending situation of coin transporting unit 18, drawing auxiliary unit 24 draws positively the held coin C; also the coin C can move quickly. Therefore, when coin C is transported quickly, first drawing auxiliary unit 77 and third drawing auxiliary unit 104 are not used. In other words, only first drawing auxiliary unit 77 is used in such a situation.

Figure 7:
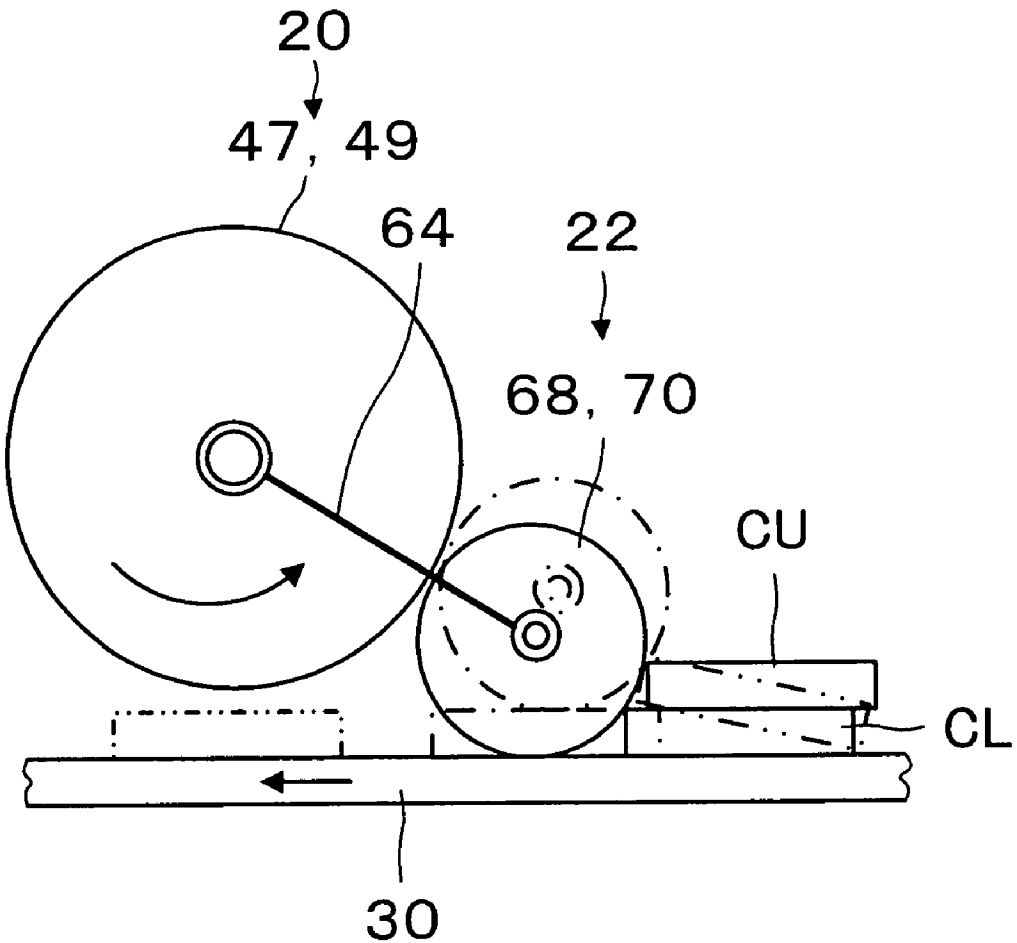
FIG. 7 is an explaining view for the operation of the embodiment where the thinnest coins are piled up.

Next, a case where the thinnest coins are piled up on belt 30 is explained with reference to FIG. 7. When piled-up coins C contact supporter unit 22, lower coin CL and upper coin CU are stopped by supporter unit 22. The lower coin CL moves together with belt 30 (with slipping), because the lower coin C has a large friction force contact with belt 30. Also, lower coin CL lifts the supporter unit 22 by a wedge effect by the arc surface of supporter unit 22, and is held between the belt 30 and supporter unit 22 (see dotted line).

Upper coin CL is stopped continually by supporter unit 22, because the friction force between metal coin CL and metal coin CU is smaller. Therefore, lower coin CL passes between separating roller 20 and belt 30, and it is transported to the next process. Upper coin CU is moved relative to the lower coin CL by supporter 20 and falls down from lower coin CU (see dotted line). Then when the upper coin CU has direct contact with belt, it can lift up supporter unit 22 as above-mentioned and is also transported beneath the separating roller 20 to the next process.

Figure 8:
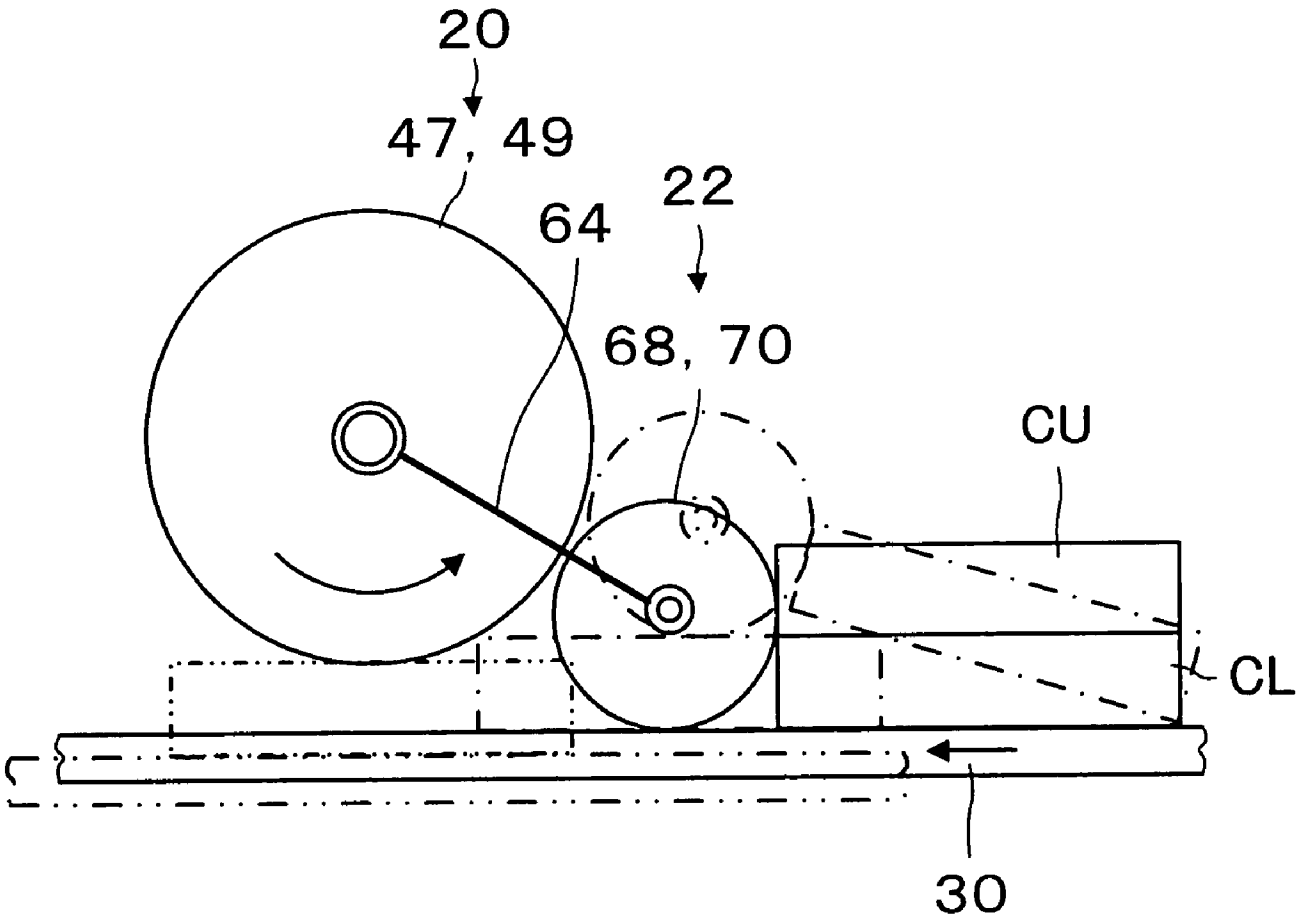
FIG. 8 is an explaining view for the operation of the embodiment where the thickest coins are piled up.

Next, a case where the thickest coins C are piled up is explained by referring to FIG. 8. When coins C contact supporter unit 22, lower coin CL and upper coin CU are stopped by supporter unit 22. However, lower coin CL moves forward together with belt 30; also the coin CL lifts supporter unit 22 by the wedge effect, because the friction between belt 30 and coin CL is larger. Therefore, the coin CL is held by belt 30 and supporter unit 22 (see dotted line).

Upper coin CU is stopped continuously by supporter unit 22, because the friction force between lower coin CL and upper coin CU is smaller, and the wedge effect does not occur, because the diameter sections of rollers 68, 70 have contact with the peripheral surface of upper coin CU. Therefore, belt 30 is bent by lower coin CL as above mentioned; also the lower coin CL is transported to next process through the space between separating roller 20 and belt 30. Upper coin CL slides off of lower coin CL (see dotted line). Therefore, the upper coin CU has contact with belt 30. Then the upper coin CL is transported to the next process in the same manner as the above-mentioned case.

Figure 9:
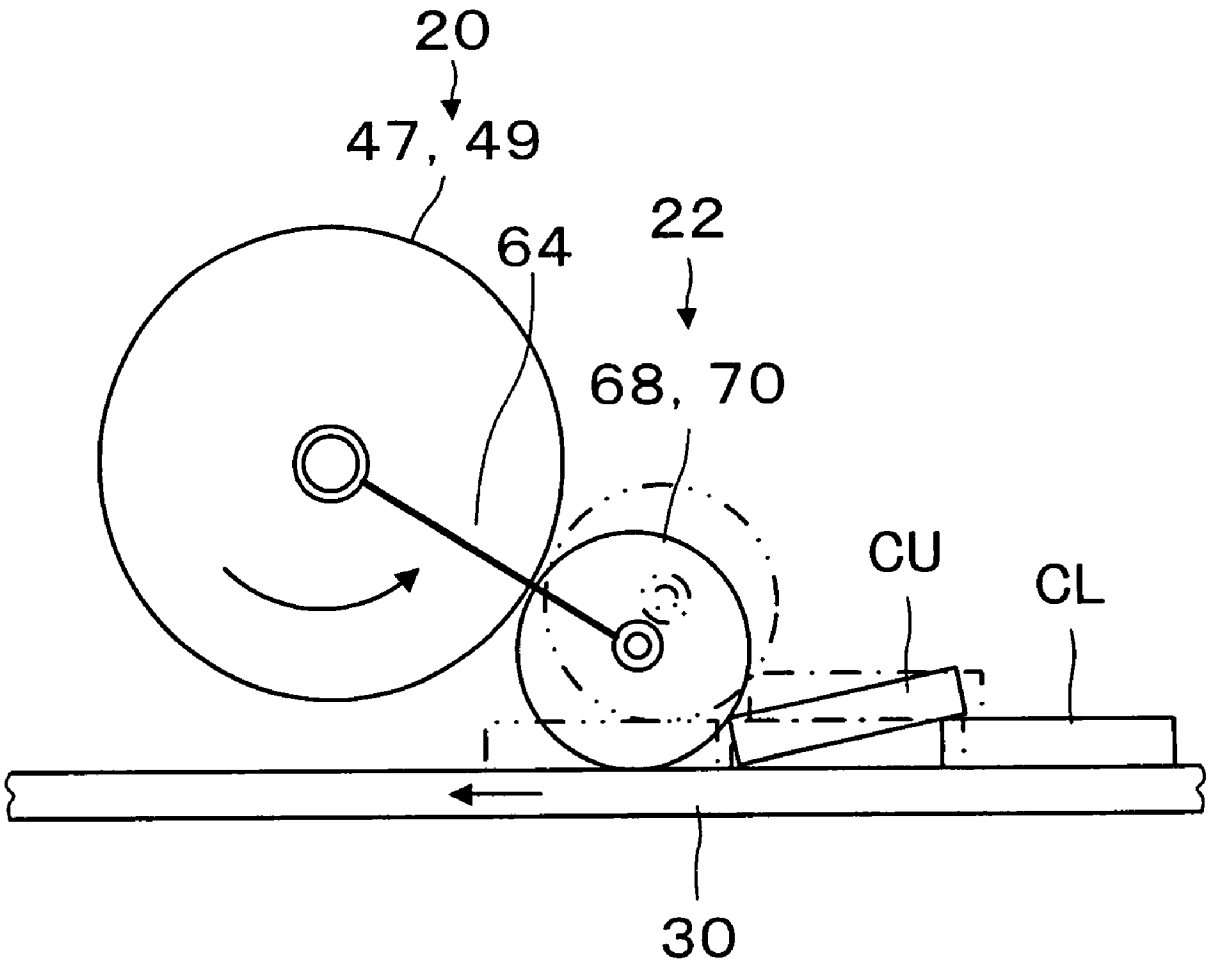
FIG. 9 is an explaining view for the operation of the embodiment where the thinnest coins are piled up in wedge shape.

Next, a case where the thinnest coins C are piled up in a wedge shape (the situation where the upper coin CU slants) is explained by referring to FIG. 9. When the piled-up coins C arrive at supporter unit 22, upper coin CU is stopped by supporter unit 22. However, the edge of upper coin CU has contact with belt 30 and a part of coin CU is supported by lower coin CL; therefore, the friction between upper coin CU and belt 30 is small. On the other hand, lower coin CL has contact with belt 30 in face; therefore, the friction between the lower coin CL and belt 30 is large. As a result, lower coin CL moves together with belt 30.

Upper coin CU is stopped by supporter unit 22, and lower coin CL moves together with belt 30. Therefore, lower coin CL moves under upper coin CU; in other words, upper coin CU moves onto and across lower coin CL (see dotted line). Afterwards, lower coin CL and upper coin CU pass through between supporter unit 22, separating roller 20 and belt 30 as explained by referring to FIG. 7, and they are transported to the next process. When upper coin CU lifts up the supporter unit 22 in the wedge-shape configuration, the end of upper coin CU has contact with separating roller 20, and it is stopped by separating roller 20.

Lower coin CL moves together with belt 30, because the friction between coin CL and belt 30 is large. Upper coin CU is stopped continuously by separating roller 20, because the contacting area between lower coin CL and belt 30 is small; however, upper coin CU is pushed to lower coin CL by supporter unit 22. Therefore, the lower coin CL goes under upper coin CU as above-mentioned. Also, only lower coin CL is initially passed through separating roller 20 and belt 30, and is transported to the next process.

Figure 10:
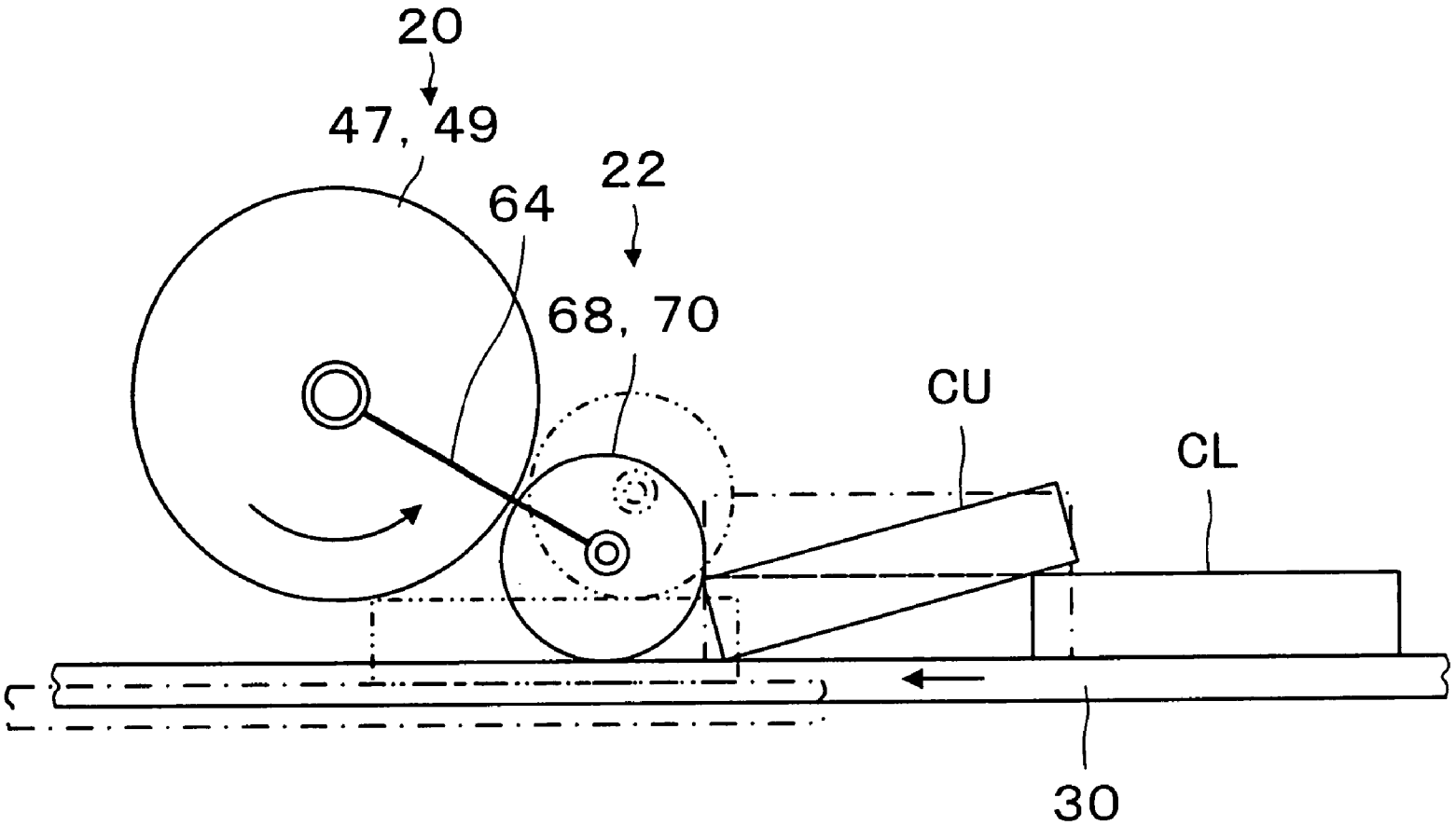
FIG. 10 is a view for explaining the operation of an embodiment where the thickest coins are piled up in wedge shape.

Next, a case where the thickest coins C are piled up in a wedge-like shape (the situation where upper coin CU slants) is explained by referring to FIG. 10. When the piled-up coins C arrive at supporter unit 22, upper coin CU is stopped by supporter unit 22. However, the edge of upper coin CU has contact with belt 30 and a part of coin CU is supported by lower coin CL; therefore, the friction between upper coin CU and belt 30 is small. As a result, upper coin CU is stopped by supporter 30, and the lower coin CL slides underneath since the lower coin CL has contact with belt 30; therefore, the friction between the lower coin CL and belt 30 is large. As a result, lower coin CL moves together with belt 30. Therefore, lower coin CL moves under upper coin CU; upper coin CU moves onto and across lower coin CL (see dotted line). Afterwards, lower coin CL and upper coin CU pass through the space between supporter unit 22, separating roller 20 and belt 30 as explained by referring to FIG. 8, and they are transported to the next process.

When upper coin CU lies on belt 30, it lifts up supporter unit 22 in the wedge shape; also it goes into the space between belt 30 and separating roller 20; it is accordingly separated one by one and is transported to the next process, the same as the above-mentioned case of the thinnest coins.

If the upper coin CU isn't stopped by separating roller 20, and it goes into the space between separating roller 20 and belt 30 in the wedge shape, the coins CU and CL can jam the space. Therefore, belt 30 and separating roller 20 stop, because belt 30 cannot bend enough. Accordingly, motor 62 is stopped by this jamming force, and it is placed in an overload situation.

A sensor (not shown) detects the overload, motor 62 is stopped based on this detection, and subsequently motor 62 is reversed for a predetermined time period. The predetermined time period is sufficient enough for removal of the jam. Therefore, gear 60 rotates in the counterclockwise direction; also pulley 26 rotates in the clockwise direction through gear 58 and rotating shaft 36 shown in FIG. 3. Accordingly, belt 30 moves to the right which is the counter direction of the transporting direction. Gear 58 is rotated in the counterclockwise direction by gear 60, and separating roller 20 is rotated in the counterclockwise direction through one-way clutch 48.

In this process, pulley 57 is rotated by rotating shaft 36 through the pulley (not shown) and belt 59; however, rotating shaft 50 does not rotate by the one-way clutch (not shown). Therefore, the jamming is cancelled, because belt 30 and separating roller 20 move in the counter direction for canceling the jam. Afterwards, motor 62 rotates in the transporting direction for the coins. In other words, the above-mentioned separating process is executed again.

In this present invention, when the thicknesses of the coins differ drastically, the supporter unit and the separating roller separate the piled-up coins one by one; also the separated coins are aligned on the transporting unit. Also, the supporter unit and the separating roller are inexpensive, because they are simple.

Those skilled in the art will appreciate that various adaptations and modifications of the just described preferred embodiment can be configured without departing from the scope and spirit of the invention. Therefore, it is to be understood that, within the scope of the amended claims, the invention may be practiced other than as specifically described herein.

What is claimed is:

1. A coin separating unit comprising:

a coin transporting unit including a flexible first rotatable belt for receiving coins of different size on a support surface of the first rotatable belt that translates the coins linearly for subsequent processing, the support surface having a predetermined flexibility and friction characteristic to engage the coins for linear translation and to enable coin movement transverse to a direction of movement where the coin transporting unit provides forward drive of the coins;

a separating roller unit positioned above the support surface at a distance no greater than twice the thickness of the coins to be separated, the surface of the separating roller unit closest to the support surface moving in a direction opposite to the movement of the support surface;

a supporter roller unit mounted on a pivotable lever is operatively located upstream of the separating roller unit, rotates freely around the rotating shaft, contacts the first rotatable belt, moves away from the first rotatable belt when the coin contacts the supporter roller unit, the separating roller unit and the supporter roller unit rotate about parallel axes extending above and across the rotatable belt, the supporter roller unit is driven by contact with the rotatable belt or passing coin and, a coplanar support member with trailing and leading edges configured to reduce interference is mounted for relative movement adjacent and underneath the flexible rotable belt to limit the extend of transverse coin movement beneath the separating roller unit to enable only a single coin to pass beneath the separating roller.

2. The coin separating unit of claim 1 wherein the separating roller unit is rigidly fixed above the support surface.

3. The coin separating unit of claim 1 further including a coin drawing auxiliary unit is located downstream of the separating roller unit.

4. The coin separating unit of claim 1 wherein the separating roller unit rotates so that its surface closest to the support surface is moving opposite to the translation direction of the support surface.

5. The coin separating unit of claim 1 wherein the supporter unit is biased by a predetermined force towards the support surface.

6. The coin separating unit of claim 5 wherein the supporter unit is biased by a spring member.

7. The coin separating unit of claim 1 further including a second coin transporting unit for receiving a coin from the first coin transporting unit and translating the coin at a faster speed than the first coin translating unit.

8. In a coin separating assembly for separating coins of different sizes, the improvement comprising:

a coin hopper for receiving various coins of different sizes in bulk;

a rotating belt positioned under the coin hopper for receiving coins from the coin hopper by a gravity feed, the rotating belt has a coplanar pivoting support member with an elongated surface for supporting an underside of the rotating belt between the rotating belt pulleys having trailing and leading edges to reduce interference with the rotating belt; and a separating roller unit positioned above the rotating belt at a distance no greater than twice the thickness of the coins to be separated, the surface of the separating roller unit closest to the rotating belt moving in a direction opposite to the movement of the support surface, wherein the rotating belt has a predetermined flexibility to enable a coin to be pushed by the separating roller unit into the rotating belt and the pivoting support member is configured to permit coin movement, on the rotating belt transverse to the directional movement of the belt, of less than twice the thickness of the thinner coin to be separated; and a supporter roller unit mounted on a pivotable lever is operatively located upstream of the separating roller unit, rotates freely around the rotating shaft, contacts the first rotatable belt, moves away from the first rotatable belt when the coin contacts the supporter roller unit, the separating roller unit and the supporter roller unit rotate about parallel axes extending above and across the rotatable belt.

9. In a coin separating assembly for separating coins of different sizes, the improvement comprising:

a coin transporting unit including a rotating belt for translating coins along a direction of movement having a predetermined flexibility to permit displacement of a coin being translated in a transverse direction;

a separating roller unit having a plurality of separating rollers rotably mounted at a fixed distance above a coin supporting surface of the rotating belt;

a supporter roller unit mounted on a pivotable lever is operatively located upstream of the separating roller unit, rotates freely around the rotating shaft, contacts the first rotatable belt, moves away from the first rotatable belt when the coin contacts the supporter roller unit, the separating roller unit and the supporter roller unit rotate about parallel axes extending above and across the rotatable belt, the supporter roller unit is driven by contact with the rotatable belt or passing coin, and a belt supporter member movably positioned to contact and support an underside of the rotating belt under the separating roller to limit a transverse movement of the rotatable belt, relative to the linear movement of the rotating belt, wherein the extent of transverse coin movement with the rotating belt only enables a single coin to pass beneath the separating roller on the rotating belt.

10. A coin separating unit comprised of:

a coin transporting unit including a first flexible belt and a second rotatable belt where plural coins are transported linearly towards a storing direction;

a separating roller which is located the first rotatable belt at a distance which is, at most, two times a thinness of the thinnest coin of the plural coins or less, when the first rotatable belt moves in the storing direction, the separating roller is fixed on a rotating shaft, a peripheral surface of the rotatable belt moves in the opposite direction to the storing direction, underneath the separating roller;

a supporter roller mounted on a pivotable lever is operatively located upstream of the separating roller, rotates freely around the rotating shaft, contacts with the first rotatable belt, moves away from the first rotatable belt when the coin contacts the supporter roller, the separating roller and the supporter roller rotate about parallel axes extending above and across the rotatable belt, the supporter roller is driven by contact with the rotatable belt or passing coin;

a first drawing auxiliary roller mounted on a pivotable lever is operatively located downstream of the separating roller and is rotated freely around the rotating shaft, and contacts the first rotatable belt; and a coplanar support member with trailing and leading edges configured to reduce interference is mounted for relative movement adjacent and underneath the rotatable first flexible belt to limit the extent of transverse coin movement against the first flexible belt beneath the separating roller unit, a second drawing roller mounted on the pivotable lever, contacting the second rotatable belt.

11. The coin separating unit as claimed in claim 10:

the first flexible rotatable belt resiliently bends downward at the position of the separating roller, which is fixed at a predetermined position above the rotatable belt when a coin passes beneath the separating roller.

12. The coin separating unit as claimed in claim 10:

the supporter roller is rotatable on a lever, which is pivotable and is coaxially mounted to the separating roller, also the supporter roller is urged to the coin transporting unit by a predetermined force.

13. The coin separating unit as claimed in claim 10:

the supporter roller has contact with the first flexible rotatable belt and is rotated by the first flexible rotatable belt.

14. The coin separating unit as claimed in claim 10:

further including a coin drawing auxiliary unit located downstream of the separating roller.

15. The coin separating unit as claimed in claim 10, the separating roller rotates in an opposed movement to the coin transporting unit.

16. The coin separating unit as claimed in claim 10:

the second drawing auxiliary roller is located downstream of the coin transporting unit and the second rotatable belt beneath the second drawing auxiliary roller moves faster than the first flexible rotatable belt.

17. The coin separating unit as claimed in claim 16:

the first drawing auxiliary roller is located downstream of the separating roller and has a distance between the first drawing auxiliary roller and the first rotatable belt which is, at most, thinner than the thinnest coin and is located upstream from the second rotatable belt.

18. The coin separating unit as claimed in claim 10:

the distance between the separating roller and the first rotatable belt is less than two times the thickness of the thinnest coin and larger than the thickness of the thickest coin of the plural coins.

19. The coin separating unit as claimed in claim 10:

the supporter roller rotates in an opposite direction to the movement of the coin transporting unit when moving a coin towards the storing direction.

20. The coin separating unit as claimed in claim 10 wherein the first flexible rotatable belt is formed with a urethane rubber surface and a polyamide core.

21. The coin separating unit as claimed in claim 10 wherein a one way clutch member provides rotation to the separating roller.

22. The coin separating unit as claimed in claim 10 wherein a diameter of the separating roller is twice a diameter of supporter roller.

23. A coin separating unit comprised of:

a coin transporting unit including a rotating belt mounted on a pair of rollers for translating coins along a linear direction of movement, the rotating belt has a predetermined flexibility to permit displacement of a coin being translated in a traverse direction to the direction of movement wherein plural coins on the rotating belt are transported towards a storing direction;

a separating roller unit is rigidly fixed above a surface of the rotating belt at a distance which is at most two times a thinness of a thinnest coin or less, the rotating belt moves in the storing direction, a peripheral surface of the separating roller unit is driven in an opposite direction to the storing direction, the rotating belt bends elastically relative to the separating roller for increasing coin passage distances between the surface of the rotating belt and the peripheral surface of the separating roller unit;

a supporter roller unit mounted on a pivotable lever is operatively located upstream of the separating roller unit, rotates freely around the rotating shaft, contacts the first rotatable belt, moves away from the first rotatable belt when the coin contacts the supporter roller unit, the separating roller unit and the supporter roller unit rotate about parallel axes extending above and across the rotatable belt, the supporter roller unit is driven by contact with the rotatable belt or passing coin;

a first drawing roller is located downstream from the separating roller unit and is located above the rotating belt to contact coins, the first drawing roller is adjacent the peripheral surface of the separating roller unit and is rotatable on a second lever which is pivotable and coaxially to the separating roller unit, the supporter roller unit is urged toward the rotating belt by gravity, to have contact with the rotating belt, and a belt supporter member movably positioned to contact and support an underside of the rotating belt under the separating roller to limit a transverse movement of the rotatable belt, relative to the linear movement of the rotating belt, wherein the extent of transverse coin movement with the rotating belt only enables a single coin to pass beneath the separating roller on the rotating belt, wherein the supporter roller unit is positioned to contact a coin on the rotating belt, and press the coin into the rotating belt by gravity, the pressed coin is nipped by the rotating belt and the separating roller unit, and the rotating belt is elastically bent by the coin, as the nipped coin passes through the distance between the rotating belt and the separating roller unit, the nipped coin is then pressed into the rotating belt by the first drawing roller and is drawn by the first drawing roller and the rotating belt, thereafter the drawn coin is transported toward a second coin transporting unit by the first drawing roller unit and the rotating belt.

24. The coin separating unit of claim 23 wherein the second coin transporting unit for receiving a coin from the rotating belt includes a second belt which is driven at a faster speed than the rotating belt, and a second drawing roller is attached to the second lever downstream from the first drawing roller, and the second drawing auxiliary roller contacts with the second belt by gravity.

* * * * *